United States Patent [19]

Molnar

[11] 4,349,866

[45] Sep. 14, 1982

[54] LIGHT REFLECTION SYSTEM WITH ASYMMETRIC REFLECTOR ASSEMBLY

[75] Inventor: John P. Molnar, St. Louis, Mo.

[73] Assignee: General Signal Corporation, Stamford, Conn.

[21] Appl. No.: 153,519

[22] Filed: May 27, 1980

[51] Int. Cl.[3] ..... F21V 7/00

[52] U.S. Cl. ..... 362/263; 362/147; 362/298; 362/300; 362/348

[58] Field of Search ..... 362/298, 299, 300, 301, 362/223, 346, 348, 362, 263, 297, 147

[56] References Cited

U.S. PATENT DOCUMENTS

| | | | |
|---|---|---|---|
| 1,902,860 | 3/1933 | Kay | 362/298 |
| 3,358,133 | 12/1967 | Thoman et al. | 362/362 |
| 4,001,575 | 1/1977 | Sullivan et al. | 362/263 |
| 4,065,667 | 12/1977 | Ruud et al. | 362/297 |
| 4,186,433 | 1/1980 | Baldwin | 362/263 |
| 4,188,657 | 2/1980 | Reibling | 362/348 |
| 4,237,528 | 12/1980 | Baldwin | 362/363 |
| 4,282,564 | 8/1981 | McJunkin, Jr. et al. | 362/223 |

FOREIGN PATENT DOCUMENTS

| | | | |
|---|---|---|---|
| 470914 | 1/1929 | Fed. Rep. of Germany | 362/298 |
| 650365 | 9/1937 | Fed. Rep. of Germany | 362/297 |
| 330425 | 7/1930 | United Kingdom | 362/362 |

*Primary Examiner*—Peter A. Nelson

*Attorney, Agent, or Firm*—John F. Ohlandt; Milton E. Kleinman

[57] ABSTRACT

A light reflection system for indirect lighting, such system being adapted for mounting on a wall or other structure in an office area or the like, comprising a boxlike housing having a central compartment in which the light reflection system is contained, such system including a high intensity discharge source of light, and a reflector assembly including a specially configured reflector which substantially surrounds the light source and judiciously reflects the light upwardly to the ceiling of the room being lighted; other, flat, reflectors are also included as part of the system.

6 Claims, 4 Drawing Figures

56

60
40
DIRECT LIGHT FROM LAMP
54
42
34
50
52
48
46
46A
46B
9
10
11

1
2
3
4
5
6
7
8
9
10
11
6°
44°
0°
43°
9°
39°
18°
34°
27°
30°
35°
26°
44°
22°
51°
18°
8°
90° CORNER
20°
90° CORNER
26°
90° CORNER

LIGHT REFLECTION SYSTEM WITH ASYMMETRIC REFLECTOR ASSEMBLY

BACKGROUND, OBJECTS AND SUMMARY OF THE INVENTION

This invention relates to a lighting system and, more particularly, to an indirect lighting system which places special emphasis on the character of the reflection means for bouncing or reflecting light off the surfaces of the rooms in which the lighting system is to be utilized.

A variety of indirect lighting systems for the illumination of room areas and the like have been extensively developed over the years. These systems are classified as indirect because they direct 90 to 100% of the light upward to the ceiling and upper side walls. In a well-designed installation the entire ceiling becomes the primary source of illumination, and shadows will be virtually eliminated. Also, since the luminaires direct very little light downward, both direct and reflected glare will be minimized if the installation is well planned. Luminaires whose luminance approximates that of the ceiling have some advantages in this respect. It is also important to suspend the luminaires a sufficient distance below the ceiling to obtain reasonable uniformity of ceiling luminance without excessive luminance immediately above the luminaires.

Since with indirect lighting the ceiling and upper walls must reflect light to the work-plane, it is essential that these surfaces have high reflectances. Even then, utilization is relatively low when compared to other systems. Care must be exercised to prevent over-all ceiling luminance from becoming too high and thus glaring.

Although the systems generally described above have their purposes and uses in providing lighting in an indirect manner, they often have drawbacks, as noted above, as well as a lack of efficiency; that is, they cannot deliver sufficient lighting for the wattage expended, which is generally expressed as illumination per watt per square foot.

Accordingly, it is a primary object of the present invention to provide an indirect lighting system that will enable greatly improved distribution of light so as to realize a higher degree of efficiency than has been possible heretofore.

The fundamental result of much greater efficiency is achieved through the medium of a specially constructed reflection means or arrangement that provides thorough asymmetric distribution and "throw" so as to provide complete coverage of a room volume. Typically, the room under consideration is approximately 30 feet wide.

Briefly stated then, a primary feature of the present invention resides in the combination of a box-like housing having an extended opening at its top, a light source disposed adjacent to the rear longitudinal wall of the housing, and an asymmetric distribution means having a reflecting surface shaped in an irregular corrugated or accordian-like pattern.

A more specific feature of the present invention resides in the fact that the requisite asymmetric distribution is achieved by means of a compactly arranged principal or main reflector. Thus, this principal reflector substantially surrounds the light source so that, except for the provision that some of the light from the source is permitted to pass directly to the ceiling or other surface above the unit, the light exiting is chiefly reflected light. The reflector is formed of extruded aluminum, having an approximately 3/32" wall thickness, and includes a judiciously located series of facets, or segments, each designed to suitably direct or redirect the light output from the source.

By reason of the aforesaid unique construction of the principal reflector, optimum light distribution is achieved or realized.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
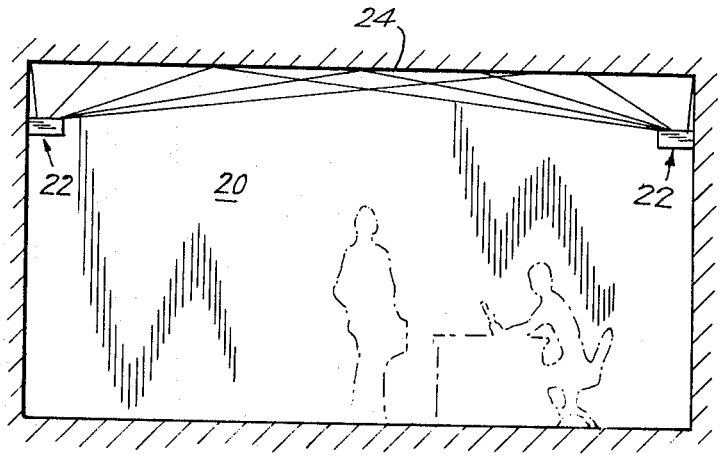
FIG. 1 illustrates a typical environment in which the device or system of the present invention may be utilized.

Referring now to the figures of the drawing and in particular, for the moment, to FIG. 1, there will be seen in that figure a typical environment in which the device or system of the present invention would be operative. In this figure there is shown a room 20 in which a pair of devices 22 are conveniently mounted on a wall thereof. In an exemplary device 22 that has actually been manufactured, dimensions have been selected to be as follows: length, 30 inches; width, 11¾; depth, 5 inches.

The pattern of lighting 24 that is achieved by the devices 22 has already been noted, but specifically, the indirect effects are realized by the optimized reflection system mounted internally of the devices 22 to be described. The result is that complete coverage of the room, that is, complete illumination on an efficient basis, is accomplished.

Figure 2:
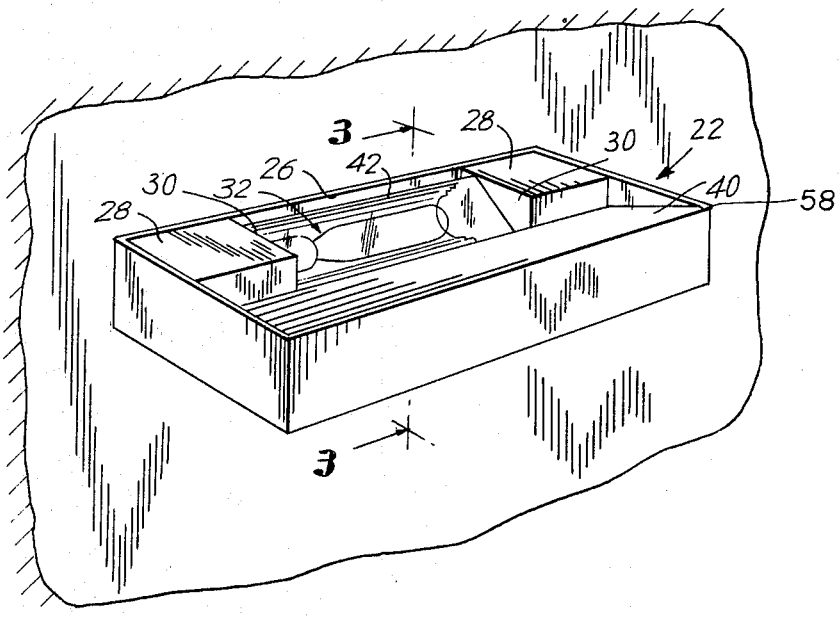
FIG. 2 is a perspective view of the lighting device or system in accordance with the present invention.
Figure 3:
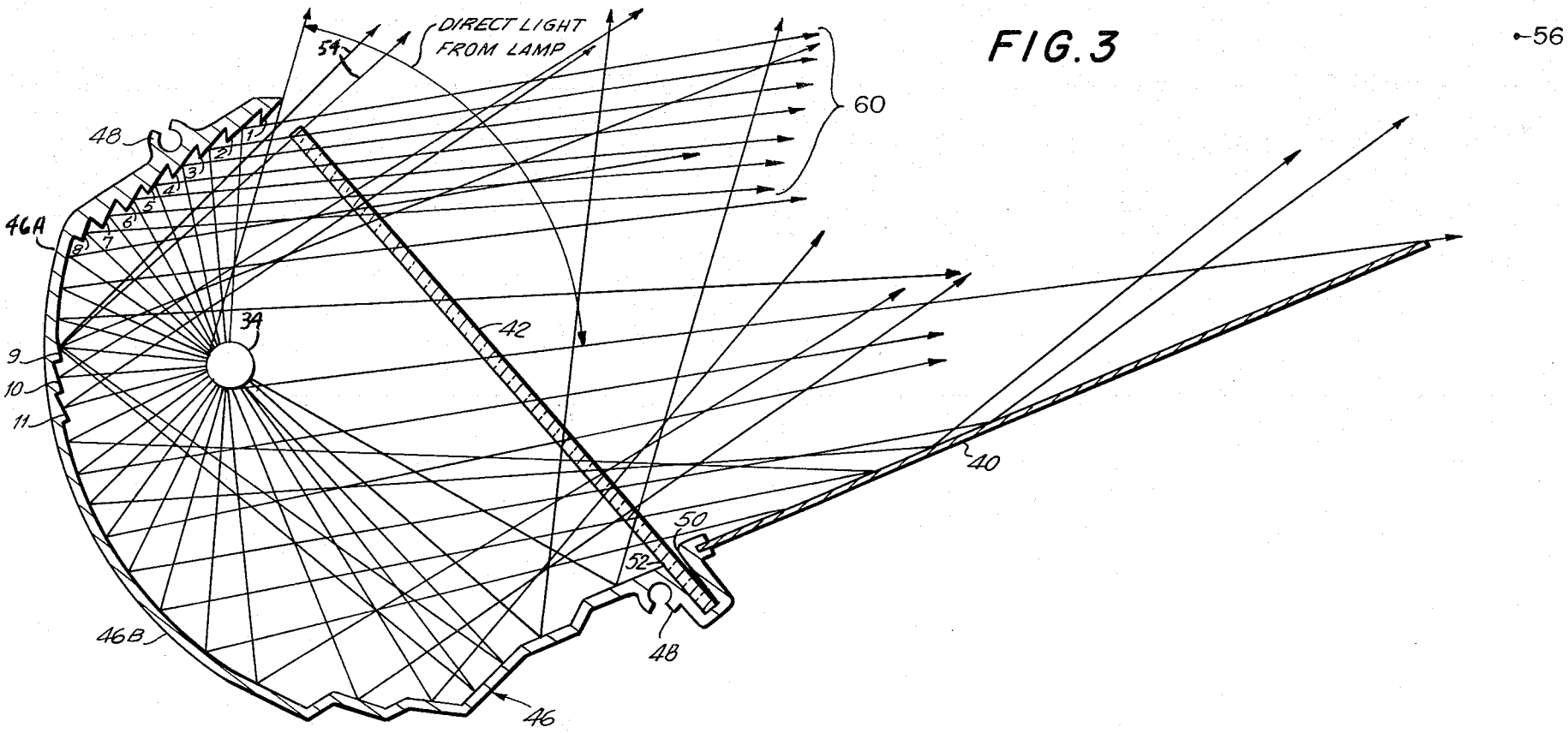
FIG. 3 is a fragmentary sectional view taken, on the line 3—3 of FIG. 2, through the principal compartment in which the lighting source and light reflection system are disposed.

Referring to FIGS. 2 and 3, there will be seen the internal arrangement within the device 22. The structure is such that three compartments are provided: the main compartment 26 in which the basic reflection system is confined, and two, auxiliary or side compartments 28 in which a capacitor, ballast and other electrical parts needed for the operation of the system are housed.

Extending longitudinally within the compartment 26 is a light source 32 consisting of a high intensity discharge lamp, preferably a high pressure sodium lamp, 250 or 400 watt size, although other similar sources could be utilized. This is an arc type of source and the light emitting element 34 has a diameter of approximately 2⅛ inches.

A flat reflector 40 extends at an appropriate angle, e.g. 28° from horizontal, in order to reflect light from the source and thence from the principal reflector upwardly toward the ceiling or other surface. A glass lens 42 is mounted at an angle of approximately 45° from horizontal in order to minimize distortion of the asymmetrically reflected light.

The principal reflector 46 is constituted of polished or specular extruded aluminum. It is arranged so as to substantially surround or wrap around the light emitting element to a significant extent; that is, to an angle of approximately 250°, as particularly seen in FIG. 3. The reflector 46 extends longitudinally in surrounding the light-emitting element 34, and extends transversely from one end plate 30 to another end plate 30 (FIG. 2), being attached to both plates by means of suitably spaced bosses 48 in which suitable screws are retained. The glass lens 42 is mounted in a receiving groove 50 at the lower part of the rim 52 of the reflector 46. The opening defined by this rim permits light from the source 32 to reach the outside of the housing at as low an angle as possible for even ceiling luminescence and maximum "throw".

The main or principal reflector 46 is, as can be seen, especially configured in an accordian-like pattern and is generally formed of a one piece aluminum extrusion approximately 3/32" thick.

Figure 4:
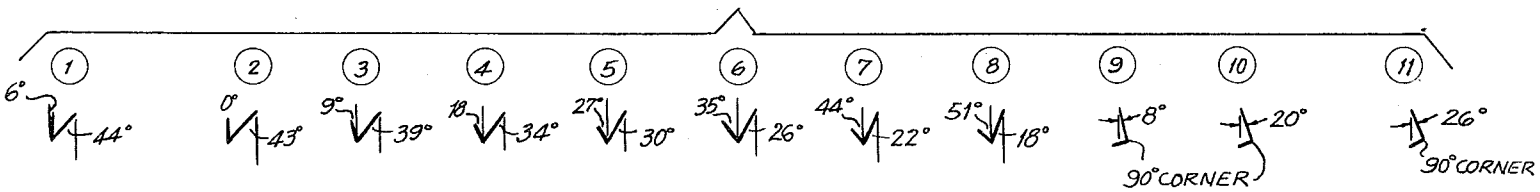
FIG. 4 is a diagram of the various reflector segment angles measured from the vertical.

It will be appreciated by those skilled in the art that the very efficient results obtained with the lighting system of the present invention result from the principle disclosed of having the reflector system or means disposed in the manner described; that is to say, particularly by having the judiciously arranged facets or segments in the accordian-like configuration substantially around the light source. Thus a series of spaced facets numbered 1–8 is provided in the upper part of FIG. 3, these being appropriately located contiguously along the inner surface of the reflector 46 at indicated angles from the vertical (as seen in FIG. 4). Likewise, a further series of facets 9, 10 and 11 are seen further down along the structure of the reflector 46. Between these two series a relatively smooth curved portion 46A is seen.

Yet another series of contiguous facets, beyond another smooth curved portion 46B, is seen at the lower part of the reflector. Some of these have a specialized re-reflection function, namely, to reflect light from the source back to a point behind the source so that it will be reflected again outwardly as indicated by the arrows 54. Otherwise, light from the source striking this area of the reflector 46 would be trapped.

It will be understood by those skilled in the art that the design for the reflector 46 as herein above described is fundamentally based on the law of physics relating the angle of incidence to the angle of reflectance, such angles being equal. Accordingly, in the design of reflector 46 a focal point 56 was established just above the front edge 58 of the fixture housing such that a major portion 60 of the reflected light would cross there. This point was chosen so as to allow light to be reflected at an angle, with respect to the horizontal, as low as possible so as to achieve maximum distance across a room. Thus the angles of all the facets noted were determined by projecting lines back from the focal point to the light center. The internal contour is accurately depicted in FIG. 3, all angles and dimensions having been measured with great precision.

While there has been shown and described what is considered at present to be the preferred embodient of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A light reflection system adapted to be mounted on the wall of a room for providing essentially uniform indirect lighting for the room comprising:

a housing having front and rear walls, a bottom wall, and side walls, and having an extended opening at its top;

a light source disposed in a horizontal orientation, said source being parallel to the rear wall of said housing and closer to the rear wall than to the front wall;

an asymetric distribution means in the form of a reflector assembly enclosed by the housing, said assembly including a main reflector wrapped substantially around said light source, said reflector extending longitudinally approximately 250° around said light source from approximately a twelve o'clock position to approximately a four o'clock position, as seen at the left side of said housing when mounted;

said main reflector having a reflecting, corrugated, inner surface comprising a series of at least six contiguous facets located adjacent said twelve o'clock position, said facets having appropriately selected varied angles so as to reflect light rays in a generally horizontal direction thereby to provide uniform distribution of light.

2. A system as defined in claim 1, in which said reflector assembly includes an auxiliary, flat reflector which is attached to said main reflector and extends upwardly therefrom at an angle of approximately 30° from the horizontal, said flat reflector transversely terminating adjacent the side walls of said housing, and longitudinally terminating at the front wall of said housing.

3. A system as defined in claim 2, further including a lens extending from the point at which said flat reflector is attached to the main reflector to the top of said housing at an angle of approximately 45° from the horizontal.

4. A system as defined in claim 1, in which said light source comprises a high intensity discharge lamp.

5. A system as defined in claim 1, in which said housing is subdivided into three compartments, a main compartment and two side or auxiliary compartments, the light source being disposed in said main compartment.

6. A system as defined in claim 5, in which an additional reflector is provided in a vertical orientation at each opposite end of said main compartment.

* * * * *